US006546078B2

(12) United States Patent
Ide

(10) Patent No.: US 6,546,078 B2
(45) Date of Patent: Apr. 8, 2003

(54) ROTARY ANODE TYPE X-RAY TUBE

(75) Inventor: Hideki Ide, Otawara (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/801,745

(22) Filed: Mar. 9, 2001

(65) Prior Publication Data

US 2002/0006183 A1 Jan. 17, 2002

(30) Foreign Application Priority Data

Mar. 9, 2000 (JP) ..... 2000-065077
Dec. 22, 2000 (JP) ..... 2000-390832

(51) Int. Cl.[7] ..... H01J 35/28

(52) U.S. Cl. ..... 378/133; 378/134; 378/125; 378/144

(58) Field of Search ..... 378/133, 134, 378/125, 144

(56) References Cited

U.S. PATENT DOCUMENTS 5,181,235 A * 1/1993 Ono et al. ..... 378/133
5,189,688 A * 2/1993 Ono et al. ..... 378/133
5,224,142 A * 6/1993 Ono et al. ..... 378/128
5,384,819 A 1/1995 Ono ..... 378/132
5,504,797 A 4/1996 Vetter ..... 378/133
5,668,849 A * 9/1997 Sugiura et al. ..... 378/133
5,673,301 A * 9/1997 Tekriwal ..... 378/130
5,809,106 A * 9/1998 Kitade et al. ..... 378/132

FOREIGN PATENT DOCUMENTS

EP 0479195 A1 * 4/1992 ..... H01J/35/10
EP 0482386 A1 * 4/1992 ..... H01J/35/10
JP 10-172483 A * 6/1998 ..... H01J/35/10

* cited by examiner

*Primary Examiner*—Drew A. Dunn
*Assistant Examiner*—Pamela R. Hobden
(74) *Attorney, Agent, or Firm*—Pillsbury Winthrop LLP

(57) ABSTRACT

An X-ray tube includes a substantially cylindrical rotor having an anode target fixed thereto, a substantially columnar stationary shaft coaxially arranged inside the rotor with a bearing gap, a dynamic slide bearing having helical grooves and formed between the rotor and the stationary shaft, and a metal lubricant supplied to the grooves and to the gap. An axial bore is formed in the shaft to extend in the longitudinal direction of the shaft, and an insertion rod is inserted into the axial bore such that a space extending in the longitudinal direction of the shaft is formed between an inner circumferential surface of the axial bore and an outer circumferential surface of the insertion rod. The space acts as at least one lubricant reservoir that is configured to store the metal lubricant.

8 Claims, 4 Drawing Sheets

ROTARY ANODE TYPE X-RAY TUBE

CROSS-REFERENCE TO RELATED APPLICATIONS

This application is based upon and claims the benefit of priority from the prior Japanese Patent Applications No. 2000-065077, filed Mar. 9, 2000; and No. 2000-390832, filed Dec. 22, 2000, the entire contents of both of which are incorporated herein by reference.

BACKGROUND OF THE INVENTION

The present invention relates to a rotary anode type X-ray tube, particularly, to an improvement of the bearing structure of the rotary anode type X-ray tube.

As known to the art, a rotary anode type X-ray tube comprises a disc-like anode target, a rotor and a stationary shaft. A bearing section is formed between the rotor and the stationary shaft, and the anode target is supported by the rotor and stationary shaft. An electromagnetic coil arranged outside a vacuum vessel receiving the rotor and stationary shaft is energized so as to rotate the rotor at a high speed. As a result, the electron beams emitted from the cathode are allowed to strike the anode target so as to achieve an X-ray emission.

The bearing section is formed of a roller bearing such as a ball bearing or a dynamic slide bearing in which helical grooves are formed in the bearing surface or section and a metal lubricant, which is in the form of a liquid during operation of the rotary anode-type X-ray tube, such as Ga or a Ga—In—Sn alloy is supplied to the bearing surface.

The rotary anode type X-ray tube utilizing the slide bearing is disclosed in, for example, Japanese Patent Disclosure (Kokai) No. 60-117531, Japanese Patent Disclosure No. 2-227948, Japanese Patent Disclosure No. 5-13028, and Japanese Patent Disclosure No. 7-192666.

It is necessary to rotate the rotary anode type X-ray tube comprising a dynamic slide bearing using a liquid metal lubricant at a high speed, e.g., at 3,000 rpm to 8,000 rpm, during the operation. In addition, the X-ray tube tends to be inclined in an unspecified direction in many cases. However, it is necessary for the dynamic slide bearing section having helical grooves to be supplied with an appropriate amount of the liquid metal lubricant over a long time regardless of the posture assumed by the X-ray tube.

In a known rotary anode type X-ray tube, a space for storing the liquid metal lubricant, i.e., a lubricant reservoir, is formed of a fine hole extending along the axis of the stationary shaft. In this construction, however, the lubricant supply duct extending from the lubricant reservoir to the bearing section is rendered undesirably long, with the result that it is difficult in some cases to supply instantly the lubricant to a specified portion of the bearing depending on the posture assumed by the X-ray tube.

It is also known to the art that a relatively large space is formed in the outer circumferential portion of a stationary shaft portion having a large diameter and constituting a thrust bearing so as to provide a lubricant reservoir. In this construction, however, the lubricant within the lubricant reservoir receives a centrifugal force in accordance with rotation of the rotor, giving rise to the inconvenience that the lubricant is less likely to be supplied to the bearing section. As described above, a stable bearing operation is unlikely to be maintained in the prior art.

BRIEF SUMMARY OF THE INVENTION

An object of the present invention is to provide a rotary anode type X-ray tube constructed to permit an appropriate amount of a liquid metal lubricant to be supplied with a high stability to the dynamic slide bearing section during operation of the X-ray tube.

According to a preferred embodiment of the present invention, there is provided a rotary anode type X-ray tube, comprising:

a substantially cylindrical rotor having an anode target fixed thereto;

a substantially columnar stationary shaft coaxially arranged inside the rotor so as to rotatably support the rotor;

a dynamic slide bearing having helical grooves and formed in the coupling portion between the rotor and the stationary shaft; and a metal lubricant supplied to the helical grooves of the slide bearing and the bearing gap, the metal lubricant being in the form of a liquid at least during operation of the X-ray tube;

wherein an axial bore is formed in the columnar stationary shaft in a manner to extend in the longitudinal direction of the stationary shaft, and an insertion rod is inserted into the axial bore such that a space extending in the longitudinal direction of the stationary shaft is formed in at least a region between the inner circumferential surface of the axial bore and the outer circumferential surface of the insertion rod, the space acting as a lubricant reservoir for storing the metal lubricant.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
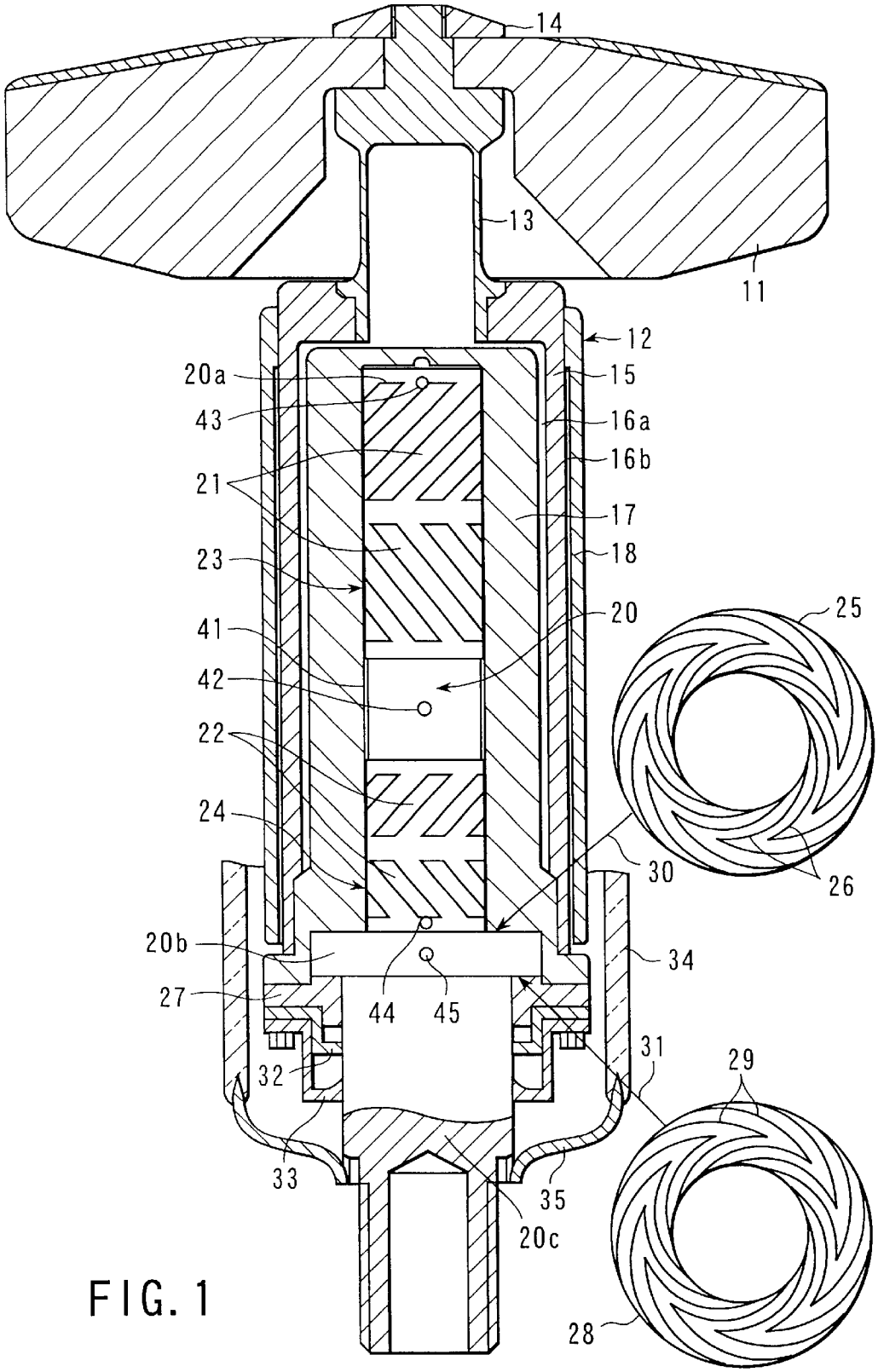
FIG. 1 a vertical cross sectional view showing a rotary anode type X-ray tube according to one embodiment of the present invention.

Rotary anode type X-ray tubes according to some embodiments of the present invention will now be described with reference to the accompanying drawings. Throughout the drawings, the same members of the X-ray tube are denoted by the same reference numerals.

Figure 2A:
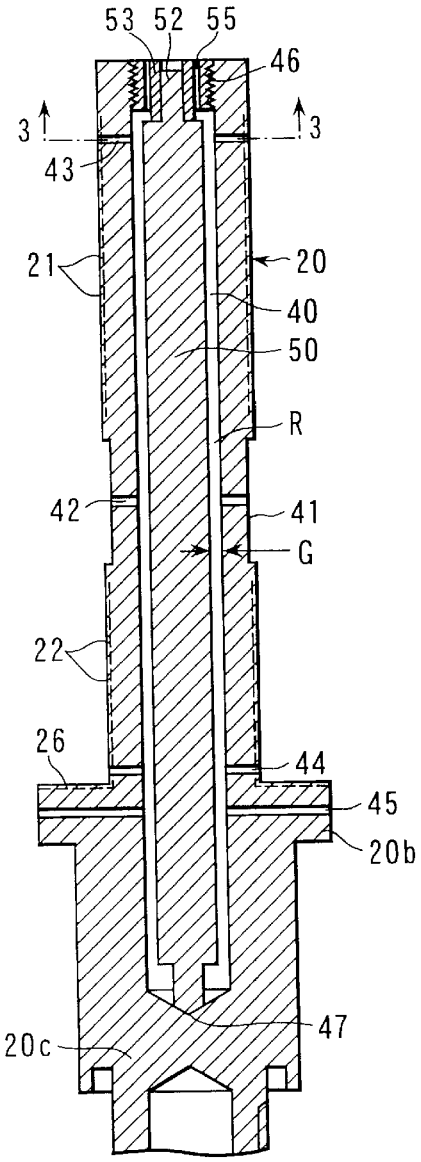
FIGS. 2A and 2B are vertical cross sectional views collectively showing the assembled state of the stationary shaft included in the rotary anode type X-ray tube shown in FIG. 1.
Figure 2B:
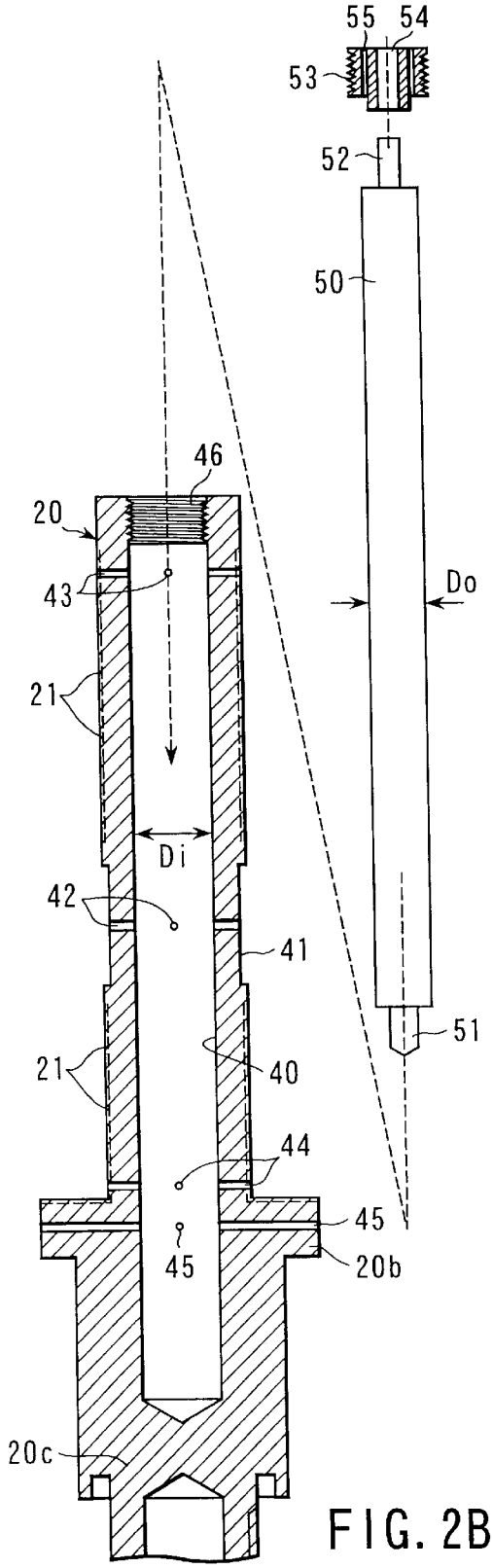
Figure 3:
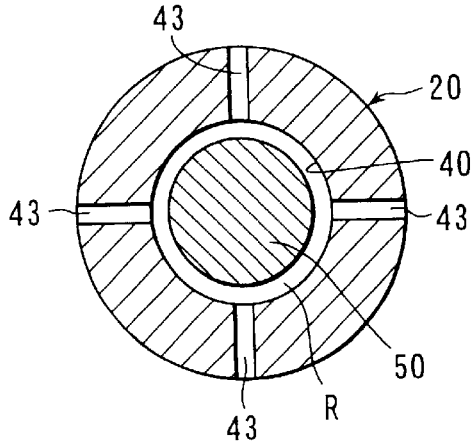
FIG. 3 is a lateral cross sectional view along the line 3—3 shown in FIG. 2A.

FIGS. 1 to 3 collectively show a rotary anode type X-ray tube according to one embodiment of the present invention. As shown in the drawings, a disc-like node target 11 made of a heavy metal is integrally fixed by a nut 14 to a rotary shaft 13 projecting upward from one end of a substantially cylindrical rotor 12 having a bottom. The rotor 12 is of a triple cylinder structure including an intermediate cylinder 15 having the rotary shaft 13 directly fixed thereto and made of iron or an iron alloy, an inner cylinder 17 arranged inside the intermediate cylinder 15 with a first heat insulating clearance 16*a* provided therebetween, and an outer cylinder 18 arranged outside the intermediate cylinder 17 with a second heat insulating clearance 16*b* provided therebetween.

A substantially columnar stationary shaft 20 is inserted into the rotor 12, particularly, into the inner space of the inner cylinder 17. The stationary shaft 20 comprises a small diameter portion 20*a* having a small diameter and positioned upward (in the drawing), a large diameter portion 20*b* having a large diameter and positioned in a lower intermediate portion, and an anode supporting portion 20*c* positioned in the lowermost portion (in the drawing).

A dynamic helical groove slide bearing in a radial direction and a thrust direction as described in the prior arts referred to previously is formed in the coupling portion between the rotor 12 and the stationary shaft 20. To be more specific, two sets of herringbone pattern helical grooves 21, 22 are formed on the outermost bearing surface of the small diameter portion 20*a* of the stationary shaft 20 so as to form two dynamic slide bearings 23, 24 in a radial direction together with the bearing surface on the inner circumferential surface of the inner cylinder 17 of the rotor 12. Also, a circular herringbone pattern helical groove 26 is formed on a bearing surface 25 on the upper side (in the drawing) of the large diameter portion 20*b* of the stationary shaft 20.

A thrust ring 27 is held stationary by a screw in a manner to close substantially the open portion, in the lower end, of the inner cylinder 17 of the rotor 12. Also, a circular herringbone helical groove 29 is formed on an upper bearing surface 28 of the thrust ring 27 in contact with the bearing surface on the lower side (in the drawing) of the large diameter portion 20*b* of the stationary shaft 20. Dynamic slide bearings 30, 31 in the thrust direction are formed by these two sets of helical grooves 26, 29 and the bearing surfaces of the stationary shaft 20 or the rotor 12 positioned close to and facing the helical grooves 26, 29.

A plurality of trap rings 32, 33 serving to prevent leakage of a lubricant are fixed on the lower side (in the drawing) of the thrust ring 27. Further, a sealing metal ring 35 of a vacuum vessel 34 made of glass is hermetically welded to a predetermined position of the outer circumferential surface of the anode supporting portion 20*c*.

A axial bore 40 having a relatively large diameter and extending along the axis of the stationary shaft 20 is formed in the substantially columnar stationary shaft 20. The axial bore 40 extends from, for example, the upper end (in the drawing) of the stationary shaft 20 to reach a region deep inside the anode supporting portion 20*c* through the large diameter portion 20*b* and has a substantially circular lateral cross sectional shape.

Formed in the stationary shaft 20 are four ducts 42 for supplying a lubricant in a radial direction, said ducts 42 extending from the axial bore 40 to communicate with the small diameter portion 41 formed in a region positioned between the two dynamic slide bearings 23, 24 in a radial direction, four ducts 43 for supplying a lubricant in a radial direction, said ducts 43 extending from the axial bore 40 to communicate with the edge portion of the dynamic slide bearing 23 in a radial direction in an upper portion (in the drawing), four ducts 44 for supplying a lubricant in a radial direction, said ducts 44 extending from the axial bore 40 to communicate with the edge portion of the dynamic bearing 24 in a radial direction positioned in a lower portion (in the drawing) and with the edge portion on the side of the inner circumferential surface of the dynamic slide bearing 30 in the upper thrust direction, and four ducts 45 for supplying a lubricant in a radial direction, said ducts 45 extending from the axial bore 40 to communicate with the outer circumferential surface of the large diameter portion 20*b* forming a dynamic slide bearing in a thrust direction. Incidentally, a female screw 46 is formed in the upper end portion (in the drawing) of the axial bore 40, and the lower end (in the drawing) of the axial bore 40 forms a sharp terminal 47.

As shown in FIGS. 2A, 2B and 3 in detail, an insertion rod 50 having an outer diameter Do slightly smaller than the inner diameter Di of the axial bore 40 and having a circular-lateral cross section is coaxially inserted into and fixed in the axial bore 40. A lower end 51 (in the drawing) of the insertion rod 50 is shaped to conform with the sharp terminal 47 of the axial bore 40, and the insertion rod 50 has a projection 52 of a small diameter in the upper end (in the drawing).

The insertion rod 50 is inserted into the axial bore 40 and the upper end portion of the insertion rod 50 is fastened by the male screw 53 so as to be fixed. As a result, the insertion rod 50 is arranged coaxially within the axial bore 40. It should be noted, however, that it is acceptable for the insertion rod 50 to be arranged somewhat eccentric or somewhat oblique relative to the axial bore 40. The male screw 53 is provided with a through-hole 54 into which the small diameter projection 53 of the insertion rod 50 can be inserted and with a plurality of through-holes 55 through which the lubricant is supplied.

By the particular combination, a cylindrical space is formed between the inner circumferential surface of the axial bore 40 and the outer circumferential surface of the insertion rod 50. If the axial bore 40 and the insertion rod 50 are arranged completely coaxial, the size G of the space in the radial direction between the two is: $G=(Di-Do)/2$, on one side.

The stationary shaft 20 of the particular construction and the rotor 12 are combined, and a metal lubricant (not shown), which is rendered liquid at least during the operation of the X-ray tube, such as a Ga alloy is supplied into the space G, each of the ducts 42, 43, 44, 45, the space formed by the small diameter portion 41, the space including the bearing gap between the stationary shaft 20 and the rotor 12, and the helical grooves. As a result, the space G between the inner circumferential surface of the axial bore 40 and the outer circumferential surface of the insertion rod 50 performs the function of a reservoir of the liquid metal lubricant, i.e., a lubricant reservoir R.

It is possible to supply the liquid metal lubricant in an amount large enough to fill completely the inner spaces noted above through which the liquid metal lubricant flows or in an amount slightly small than the amount noted above. As a result, the lubricant is supplied instantly and in a suitable amount to each of the bearing sections during operation of the X-ray tube no matter what posture the X-ray tube may assume because the lubricant reservoir R is positioned close to each of the dynamic slide bearings and is connected to each of the bearing sections via a relatively short duct.

It should also be noted that, since the lubricant reservoir R is formed of the space G between the inner circumferential surface of the axial bore 40 and the outer circumferential surface of the insertion rod 50, the liquid metal lubricant need not be stored in a large amount larger than required. It has been confirmed by the actual measurement conducted by the present inventors that it is desirable for the supply amount of the liquid metal lubricant to be not smaller than 50% and not larger than 80% of the inner space volume.

It is desirable for at least those surfaces of the stationary shaft 20 and the insertion rod 50 which collectively form the lubricant reservoir R, i.e., the space G, to be formed of a material that is unlikely to be corroded by the liquid metal lubricant and that is well wetted with the lubricant during operation of the X-ray tube. Where the particular portions of the stationary shaft 20 and the insertion rod 50 are formed of the particular material noted above, the liquid metal lubricant is capable of a smooth movement within the reservoir R so as to maintain a stable operation over a long time.

It should be noted, however, that it is practically difficult to process the entire region of the inner circumferential surface of the axial bore 40 of the stationary shaft 20 to be well wettable with the liquid metal lubricant, thought it is ideal to permit both the inner circumferential surface of the axial bore 40 of the stationary shaft 20 and the outer circumferential surface of the insertion rod 50 to be well wettable with the liquid metal lubricant. Under the circumstances, it is practically desirable to make substantially the entire region of the outer circumferential surface of the insertion rod 50 wettable with the liquid metal lubricant because it is relatively easy to prepare such an insertion rod.

The stationary shaft 20 or the insertion rod 50 should desirably be formed of, for example, molybdenum, tungsten, niobium, tantalum, or an alloy based on these metals, iron, an iron alloy, nickel, a nickel alloy and other metallic materials, and a ceramic material. It is also possible to coat the surface of the stationary shaft 20 or the insertion rod 50 formed of the materials exemplified above with a film of a material that is unlikely to be corroded by the liquid metal lubricant and that can be wetted easily with the lubricant.

In order to prevent the mechanical strength of the stationary shaft 20 from being undesirably lowered, the inner diameter Di of the axial bore 40 should be not larger than 80%, preferably not larger than 70%, of the outer diameter of the stationary shaft 20, and should be not smaller than 20%, preferably not smaller than 30%, of the outer diameter of the stationary shaft 20 in view of the construction that the insertion rod 50 is inserted into the axial bore 40 so as to form the lubricant reservoir R between the outer circumferential surface of the insertion rod 50 and the inner circumferential surface of the axial bore 40. To be more specific, where the outer diameter of the stationary shaft 20 is, for example, about 20 mm, the inner diameter Di of the axial bore 40 should be, for example, about 10 mm.

Under the state that the insertion rod 50 is coaxially arranged within the axial bore 40, the size G in the radial direction on one side of the lubricant reservoir R formed between the inner circumferential surface of the axial bore 40 and the outer circumferential surface of the insertion rod 50 should practically be not smaller than 0.2 mm, preferably not smaller than 0.5 mm. Incidentally, the upper limit of the size G noted above should practically be about 2 mm. To be more specific, where the inner diameter of the axial bore 40 is, for example, about 10 mm as noted above, the outer diameter Do of the insertion rod 50 should be about, for example, 8 mm. In this case, the size G in the radial direction of the lubricant reservoir R is about 1 mm on one side.

Figure 4:
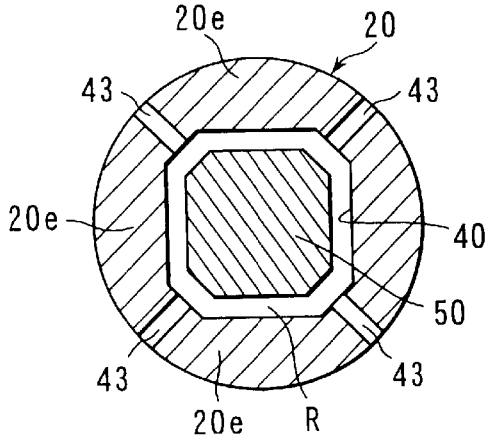
FIG. 4 is a lateral cross sectional view showing a gist portion of a rotary anode type X-ray tube according to another embodiment of the present invention.

FIG. 4 shows another embodiment of the present invention. In the embodiment shown in FIG. 4, an axial bore 40 having a substantially square lateral cross sectional shape is formed in the stationary shaft 20, and an insertion rod 50 having a substantially square lateral cross sectional shape and sized slightly smaller than the axial bore 40 is coaxially inserted into the axial bore 40 so as to utilize the space between the two as the lubricant reservoir R. In this case, a plurality of ducts 43 for the lubricant circulation, which radially extend outward from the lubricant reservoir R, are formed in four thin wall portions in the lateral cross section of the stationary shaft 20.

In the construction shown in FIG. 4, the lubricant reservoir R communicates with the bearing regions through the short ducts 43 formed in the thin wall portions of the stationary shaft 20, making it possible to supply the lubricant to the bearing sections more promptly. On the other hand, since the stationary shaft 20 has four thick wall portions 20*e* in its lateral cross section, it is possible to secure a sufficiently high mechanical strength of the stationary shaft 20.

Figure 5:
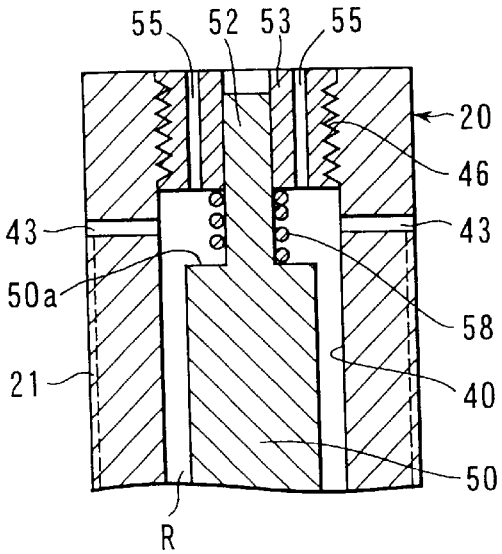
FIG. 5 is a lateral cross sectional view showing a gist portion of a rotary anode type X-ray tube according to another embodiment of the present invention.

FIG. 5 shows another embodiment of the present invention. In the embodiment shown in FIG. 5, a spring 50 is wound about the projection 52 having a small diameter and positioned in the upper end portion (in the drawing) of the insertion rod 50. The spring 58 is arranged between an upper end shoulder portion 50*a* of the insertion rod 50 and the male screw 53 so as to push the insertion rod 50 downward (in the drawing).

According to the construction shown in FIG. 5, it is possible to eliminate the inconvenience caused by the difference in the thermal expansion between the stationary shaft 20 and the insertion rod 50, which is generated during operation of the X-ray tube. To be more specific, the difference in the thermal expansion can be absorbed by the spring function of the spring 58, with the result that the insertion rod 50 is prevented from being undesirably vibrated or moved.

Figure 6A:
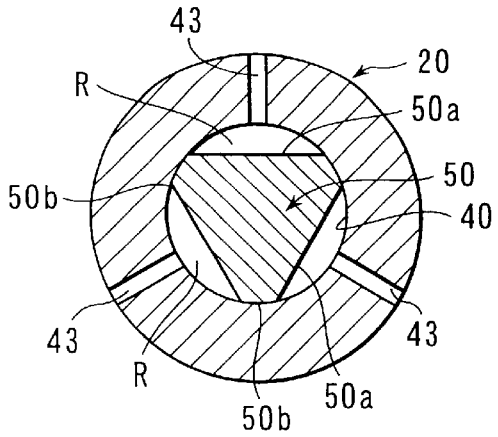
FIGS. 6A and 6B are a lateral cross sectional view and an oblique view, respectively, each showing a gist portion of a rotary anode type X-ray tube according to another embodiment of the present invention.
Figure 6B:
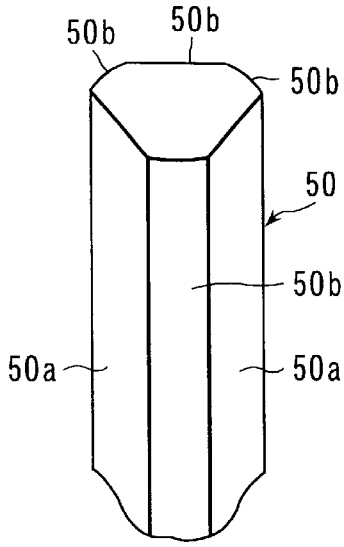

FIGS. 6A and 6B collectively show another embodiment of the present invention. In the embodiment shown in these drawings, an insertion rod 50 having three portions of the outer circumferential surface flattened in the longitudinal direction is inserted into the axial bore 40 of the stationary shaft 20, said axial bore 40 having a circular lateral cross sectional shape. To be more specific, the insertion rod 50 having a circular lateral cross section is prepared and three regions of the outer circumferential surface thereof is cut, said three regions being equidistantly apart from each other in the outer circumferential direction, to form three flat faces 50*a*.

Under the state that the insertion rod 50 is inserted into the axial bore 40, three arcuate portions 50*b*, which are not cut, are in tight contact with the parts of the inner circumferential surface of the axial bore 40 of the stationary shaft 20, with the result that the insertion rod 50 is fixed mechanically stably. Also, three spaces G, i.e., lubricant reservoirs R, are formed between the flat surfaces 50*a* of the insertion rod 50 and the inner circumferential surface of the axial bore 40. In addition, formed are radial ducts 43 extending from the lubricant reservoirs R to communicate with the outer circumferential surface of the stationary shaft 20 forming the dynamic bearing surface.

According to the embodiment shown in FIGS. 6A and 6B, the insertion rod 50 inserted into the axial bore 40 of the stationary shaft 20 is in contact with the inner circumferential surface of the axial bore 40 in a plurality of points, with the result that a high mechanical strength is maintained over the entire stationary shaft. Incidentally, in the embodiment described above, there are three longitudinal contact portions between the axial bore of the stationary shaft and the insertion rod. However, the present invention is not limited to the particular construction. It is possible for the insertion rod 50 to be in contact with the inner circumferential surface of the axial bore 40 in two portions or in four portions or more.

Figure 7:
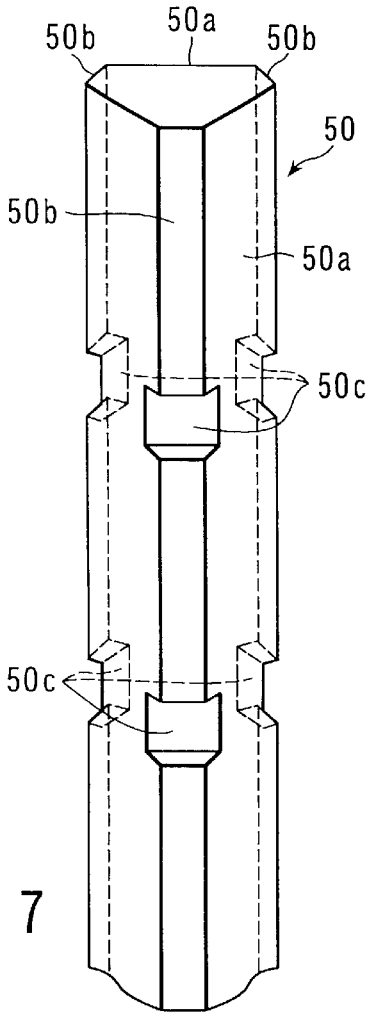
FIG. 7 is an oblique view showing a gist portion of a rotary anode type X-ray tube according to another embodiment of the present invention.

FIG. 7 shows another embodiment of the present invention. The embodiment shown in FIG. 7 is substantially same as that shown in FIGS. 6A and 6B, except that a plurality of slits 50*c* are formed to extend in the circumferential direction of the insertion rod 50 in the embodiment shown in FIG. 7. If the insertion rod 50 is inserted into the axial bore (not shown) of the stationary shaft, the three lubricant reservoirs R extending in the axial direction are allowed to communicate with each other in the circumferential direction through these slits 50*c*. As a result, the liquid metal lubricant within the reservoirs R is promptly moved in every direction so as to be supplied through the ducts to the dynamic bearing regions having helical grooves regardless of the posture assumed by the X-ray tube. It follows that the bearing function of a further improved reliability can be guaranteed.

Figure 8:
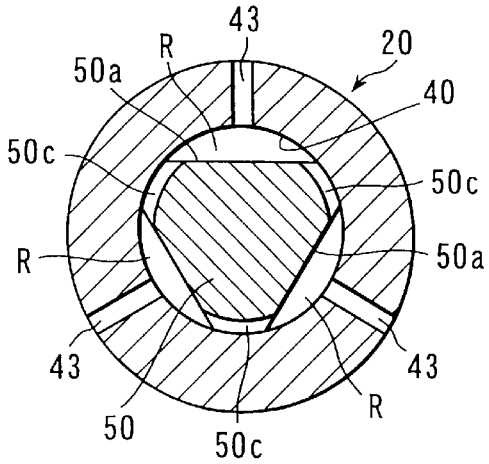
FIG. 8 is an oblique view showing a gist portion of a rotary anode type X-ray tube according to still another embodiment of the present invention.

FIG. 8 shows a still another embodiment of the present invention. In the embodiment shown in FIG. 8, a plurality of slits 50*c* extending in the circumferential direction are also formed in the insertion rod 50, as in the embodiment shown in FIG. 7. In addition, the positions of these slits 50*c* in the longitudinal direction of the stationary shaft 20 are aligned with the positions of the radial ducts 43 for the lubricant circulation, particularly, the communicating positions of these ducts 43 with the lubricant reservoirs R, in the longitudinal direction of the stationary shaft 20.

According to the construction shown in FIG. 8, the metal lubricant circulated among the lubricant reservoirs R through the slits 50*c* is allowed to flow easily into the ducts 43 extending in the radial direction for the lubricant circulation, with the result that the lubricant supply to the dynamic bearing regions can be further ensured.

In the construction shown in FIG. 8, the ducts 43 extending in the radial direction for the lubricant circulation are open in the positions of the lubricant reservoirs R. However, it is also possible to allow the ducts 43 extending in the radial direction for the lubricant circulation to be open in the positions of the slits 50*c* that also perform the function of the space forming the lubricant reservoir.

Incidentally, in the exhausting step included in the manufacturing process of the rotary anode type X-ray tube of this type, the gases present in the bearing regions, the lubricant reservoirs, the ducts, etc. can be released easily and without fail through these lubricant reservoirs, ducts, the slits extending in the circumferential direction, etc., making it possible to obtain an X-ray tube substantially free from the gases housed therein.

The metal lubricant used in the present invention can be formed of a Ga-based material such as Ga, a Ga—In alloy or a Ga—In—Sn alloy. In addition, it is also possible to use a Bi-based material such as a Bi—In—Pb—Sn alloy or an In—based material such as an In—Bi—Sn alloy for forming the metal lubricant. Since these materials have a melting point higher than room temperature, it is desirable to preheat the metal lubricant to temperatures not lower than the melting point of the metal lubricant before the anode target is rotated.

As described above, the present invention makes it possible to promptly supply an appropriate amount of the liquid metal lubricant to the dynamic slide bearings during operation of the X-ray tube so as to maintain a stable bearing function.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A rotary anode type X-ray tube, comprising:

a substantially cylindrical rotor having an anode target fixed thereto;

a substantially columnar stationary shaft coaxially arranged inside the rotor so as to rotatably support the rotor, the columnar stationary shaft forming an axial bore having an inner circumferential surface that extends in a longitudinal direction thereof, a dynamic slide bearing having a plurality of helical grooves and a bearing gap formed between the rotor and the stationary shaft;

a metal lubricant supplied to the helical groves of the slide bearing and the bearing gap, said metal lubricant being in the form of a liquid at least during operation of the X-ray tube; and an insertion rod having an outer circumferential surface being configured to be coaxially inserted into the axial bore, wherein a space extending in the longitudinal direction of the stationary shaft is formed in at least a region between the inner circumferential surface of the axial bore and the outer circumferential surface of the insertion rod, said space acting as at least one lubricant reservoir configured to store the metal lubricant.

2. The rotary anode type X-ray tube according to claim 1, further comprising a duct configured to supply said metal lubricant, said duct extending in a radial direction, said metal lubricant being supplied from said at least one lubricant reservoir into said slide bearing through said duct.

3. The rotary anode type X-ray tube according to claim 1, wherein said axial bore has an inner diameter within a range of 20% to 80% of an outer diameter of said columnar stationary shaft.

4. The rotary anode type X-ray tube according to claim 1, wherein the space formed between the inner circumferential surface of said axial bore and the outer circumferential surface of said insertion rod has a size of at least 0.2 millimeters in a radial direction.

5. The rotary anode type X-ray tube according to claim 1, wherein said insertion rod is mechanically held by a mechanism configured to absorb the difference in thermal expansion between said stationary shaft an said insertion rod.

6. A rotary anode type X-ray tube, comprising:

a substantially cylindrical rotor having an anode target fixed thereto;

a substantially columnar stationary shaft coaxially arranged inside the rotor so as to rotatably support the rotor, the columnar stationary shaft forming an axial bore having an inner circumferential surface that extends in a longitudinal direction thereof;

a dynamic slide bearing having a plurality of helical grooves and a bearing gap formed between the rotor and the stationary shaft;

a metal lubricant supplied to the helical groves of the slide bearing and the bearing gap, said metal lubricant being in the form of a liquid at least during operation of the X-ray tube; and an insertion rod having an outer circumferential surface being configured to be coaxially inserted into the axial bore, wherein a space extending in the longitudinal direction of the stationary shaft is formed in at least a region between the inner circumferential surface of the axial bore and the outer circumferential surface of the insertion rod, said space acting as at least one lubricant reservoir configured to store the metal lubricant, and wherein said insertion rod has a noncircular lateral cross sectional shape, said insertion rod has a contact surface region which extends in the longitudinal direction of said stationary shaft and is in contact with the inner circumferential surface of said axial bore, and another surface region positioned to face the inner circumferential surface of said axial bore, wherein the space is defined between the another surface and the inner circumferential surface of said axial bore.

7. The rotary anode type X-ray tube according to claim 6, wherein said insertion rod is provided with at least one slit formed in the surface region to permit the at least one lubricant reservoir to communicate with the slit.

8. The rotary anode type X-ray tube according to claim 7, further comprising a duct configured to supply said metal lubricant, said duct extending in a radial direction and said metal lubricant being supplied from said at least one lubricant reservoir into said slide bearing through said duct, wherein the position of the at least one slit, in the longitudinal direction of the stationary shaft, coincides with the position, in the longitudinal direction of said stationary shaft, of a portion of the duct that is open to the space.

* * * * *